US005595962A

United States Patent [19]

Caporiccio et al.

[11] Patent Number: 5,595,962

[45] Date of Patent: Jan. 21, 1997

[54] FLUOROSILICONE LUBRICANT COMPOSITIONS

[75] Inventors: Gerardo Caporiccio, Milan, Italy; Hugh A. Spikes, London, England

[73] Assignee: Dow Corning Corporation, Midland, Mich.

[21] Appl. No.: 585,674

[22] Filed: Jan. 16, 1996

[30] Foreign Application Priority Data

Jun. 29, 1995 [IT] Italy ..... MI95A1395

[51] Int. Cl.[6] ..... C10M 107/50

[52] U.S. Cl. ..... 508/206; 508/371; 508/372; 508/373; 508/374; 508/375; 508/377; 508/384

[58] Field of Search ..... 252/49.7, 49.6, 252/49.9, 32.7 E, 56 R, 56 D, 33.3

[56] References Cited

U.S. PATENT DOCUMENTS

| | | | |
|---|---|---|---|
| 2,199,944 | 5/1940 | Johannes van Peski et al. | 252/49.7 |
| 2,763,617 | 9/1956 | Scott et al. | 252/49.7 |
| 3,008,901 | 11/1961 | Baker et al. | 252/49.7 |
| 3,385,790 | 5/1968 | Davies et al. | 252/32.7 E |
| 3,386,917 | 6/1968 | Schiefer | 252/49.9 |
| 3,390,087 | 6/1968 | Pellegrini, Jr. et al. | 252/49.7 |
| 3,481,872 | 12/1969 | Dolle, Jr. et al. | 252/49.9 |
| 3,629,115 | 12/1971 | Kim | 252/49.9 |
| 5,445,751 | 8/1995 | Kanzaki et al. | 252/49.6 |

OTHER PUBLICATIONS

Recent Advances in Silicone Oil Lubricants; Quall and Groenhof, pp. 101–110. (Date unknown).

Silicone Lubrication of Porous Bronze Bearings; Braun and Groenhof, Apr., 1975 Lubrication Engineering; pp. 176–182.

Khim. i Tekhn. Topliv i Masel, vol. 10, pp. 59–61 (1971) (month unknown).

High Temperatrue Antioxidants for Hydraulic Fluids and Lubricants; Acton, Moran and Silverstein; Journal of Chemical Engineering, vol. 6 No. 1, Jan. 1961.

*Primary Examiner*—Margaret Medley

*Attorney, Agent, or Firm*—Alexander Weitz

[57] ABSTRACT

A lubricant composition is disclosed which provides good antiwear characteristics in air at ≧100° C. and exhibits a low friction coefficient, said composition comprising:

(A) a fluorosilicone oil;

(B) at least one compound selected from the group consisting of ferrocene, 1,1'-bis(diphenylphosphino) ferrocene and an N,N-disalicylidene-diaminoalkane in which the alkane portion has 3–6 carbon atoms; and (C) at least one phosphorous compound selected from the group consisting of triphenylphosphine, tri-o-tolylphosphine, 1,5-bis-diphenylphosphinopentane and a dialkyldithiophosphate salt in which the alkyl groups have 1–14 carbon atoms, wherein said components (B) and said component (C) is each present at a level of 0.01 to 0.3 percent based on the total weight of said composition.

30 Claims, No Drawings

FLUOROSILICONE LUBRICANT COMPOSITIONS

FIELD OF THE INVENTION

The present invention relates to fluorosilicones having improved antiwear properties. In particular, it relates to fluorosilicone formulations which show good antiwear properties at high temperatures and in air. These formulations also unexpectedly exhibit a low coefficient of friction (COF).

BACKGROUND OF THE INVENTION

It is well known that fluorosilicones are used as lubricant oils and base fluids for greases. They also show good rheological properties and resistance to degradation and oxidation. However, this lubricant behavior, which is satisfactory at relatively low temperatures (e.g., up to 100° C.) tends to progressively worsen at higher temperatures (e.g., from 100° to 200° C. and higher). The prior art has taught the use of various additives, such as antioxidants and/or antiwear agents, in an attempt to extend the practical application temperature range of fluorosilicones. But, e.g., Braun et al., in an article entitled "Silicone Lubrication of Porous Bronze Bearings" (Lub. Eng., 32, 176–182, 1975) found some antioxidants to be ineffective. Further, some fatty ester antiwear agents were found to give similar unsatisfactory results.

Kim et al. (U.S. Pat. No. 3,629,115) suggested the use of fluorinated phenylphosphine as both an antioxidant and an antiwear additive in fluorosilicones. However, the antiwear properties of these compositions are not satisfactory in practice.

Kobzova et al., in an article entitled "Efficiency of Antioxidants in Phthalocyanine Greases" (Khim. i Tekhn. Topliv i Masel, No. 10, pp 59–61, 1971) showed that conventional antioxidants, such as N-phenyl-α-naphthylamine, are nearly ineffective in fluorosilicone-based greases.

Therefore, from an application standpoint, there is still a need for agents which, when added to fluorosilicones, result in effective lubricants for use in air at temperatures higher than 100° C., particularly at 125° C. to 200° C., and higher.

SUMMARY OF THE INVENTION

Experiments carried out by the instant inventors showed that many antioxidants, as well as many antiwear agents known in the art, appeared to be unsatisfactory when used as additives in fluorosilicones. Moreover, it was found that many such combinations were not able to improve lubricant properties in the temperature range from about 100° C. to 200° C. as measured by wear tests in the presence of air and/or as measured by the Shell four ball wear test, described infra.

It is therefore an object of the present invention to provide a lubricant composition and method based on a fluorosilicone oil, said composition showing effective antiwear characteristics under conditions of aging in air in a broad range of temperatures (up to 200° C. or higher) and imparting a low coefficient of friction (COF) in, lubrication applications.

The lubricant composition of the present invention comprises (A) a fluorosilicone oil;

(B) at least one compound selected from the group consisting of ferrocene, 1,1'-bis(diphenylphosphino) ferrocene and an N,N-disalicylidene-diaminoalkane in which the alkane portion has 3–6 carbon atoms; and (C) at least one phosphorous compound selected from the group consisting of triphenylphosphine, tri-o-tolylphosphine, 1,5-bis-diphenylphosphinopentane and a dialkyldithiophosphate salt in which the alkyl groups have 1–14 carbon atoms.

The combination of above described components (B) and (C) have a synergistic effect in improving the antiwear characteristics of fluorosilicones and provide stable and efficient lubricants which exhibit a low COF and can be used at temperatures greater than 100° C.

As another object of the invention, it has unexpectedly been found that the antiwear characteristics of the instant fluorosilicone formulations at high temperatures and in the presence of air can be further improved by adding at least one component (D) selected from the group consisting of a dialkyl naphthalene sulphonate salt in which the alkyl groups have 6–12 carbon atoms, alkenyl succinic acid hemiester in which the alkenyl groups have 6–18 carbon atoms and mixtures of the above.

The present invention has been disclosed in Italian Patent Application No. MI 95 A 001395, filed on Jun. 29, 1995, which is hereby incorporated by reference.

DETAILED DESCRIPTION OF THE INVENTION

The fluorosilicone (FS) oil which is preferably used as component (A) is a poly(3,3,3-trifluoropropylmethylsiloxane) having the general formula $$(CH_3)_3\,Si—\{O—Si(CH_3)(CH_2CH_2R_f)\}_p—O\,SI(CH_3)_3, \qquad \text{(i)}$$

In formula (i), $R_f$ is a fluorocarbon group of the formula $C_nF_{2n+1}$ in which n is an integer having a value of 1 to 4. In formula (i), p has an average value such that the viscosity at room temperature (i.e., about 25° C.) of the base oil ranges from about 50 to 10,000 centistokes (cs), preferably 200–3,000 cs and most preferably 800–1,600 cs. Such fluorosilicone fluids are marketed by Dow Corning Corporation as FS® 1265 when $R_f$ is $CF_3$.

Component (B) is at least one compound selected from the group consisting of ferrocene, 1,1'-bis(diphenylphosphino) ferrocene and an N,N-disalicylidene-diaminoalkane in which the alkane portion has 3–6 carbon atoms, preferably, N,N-disalicylidene-1,3-diaminopropane.

Component (C) is at least one phosphorous compound selected from the group consisting of triphenylphosphine, tri-o-tolylphosphine, 1,5-bis-diphenylphosphinopentane and a dialkyldithiophosphate salt in which the alkyl groups have 1–14 carbon atoms, preferably the zinc salt of 2-ethylhexyl dithiophosphate.

In highly preferred embodiments of the present invention, a third additive, component (D), is also included in the composition. Component (D) is at least one compound selected from the group consisting of a dialkyl naphthalene sulphonate salt in which the alkyl groups have 6–12 carbon atoms, preferably dinonyl naphthalene sulphonic acid calcium salt, and alkenyl succinic acid hemiester in which the alkenyl groups have 6–18 carbon atoms, preferably dodecenyl succinic acid methyl hemiester.

To prepare the lubricating compositions of the invention, component (B) and component (C) are uniformly dispersed in fluorosilicone (A) such that (B) and (C) each comprises 0.01 to 0.3 weight percent of the final dispersion. Preferably, components (B) and (C) each comprises 0.03 to 0.25% by weight, most preferably from 0.05 to 0.2% by weight, of the total composition. When component (D) is used, it is also added at a level of 0.01 to 0.3% by weight based on the total composition, preferably at a level of 0.01 to 0.2% by weight. Any suitable means of mixing these components to uniformity may be employed and the order of addition is not critical. Higher amounts may be used provided that the temperature of use allows the additive to be homogeneously dispersed in the lubricant composition.

The above mentioned synergistic effect with respect to antiwear properties is observed both when the fluorosilicone compositions of the invention are used as liquid lubricants or as bases for greases for application at high temperatures in air. Such a grease can be prepared by thickening the fluid with a thickener, preferably polytetrafluoroethylene (PTFE), as well known in the lubricant arts.

Compositions of the present invention also exhibit a reduced coefficient of friction (COF). It is well known to those skilled in the lubrication art that, the lower the COF, the better the lubrication performance. This is particularly significant at high temperatures. The instant inventors have unexpectedly and surprisingly found that the formulations according to the present invention allow not only the above mentioned improvement of antiwear properties at high temperatures in air, but also exhibit about half the friction coefficients measured on the best fluorinated fluids know in the art. Thus, according to the existing state of the art in the field of the fluorinated lubricants, the lowest COF is approximately 0.1, whereas the FS formulations of the present invention typically exhibit a COF in the range of only 0.04–0.05.

According to the method of the present invention, the above described compositions may be used as lubricants to reduce the frictional wear of metal surfaces which are in actual contact or can enter into contact under load during relative rolling or sliding motion. The compositions of the invention thus find utility as a lubricant for bearings, compressors, slides, gears and the like.

Non-limiting examples of the metals which benefit from the instant lubricating method include steel, stainless steel, iron, bronze, brass, nickel, titanium and copper.

EXAMPLES

The following examples are presented to further illustrate the compositions and method of this invention, but are not to be construed as limiting the invention, which is delineated in the appended claims. All parts and percentages in the examples are on a weight basis unless indicated to the contrary.

The additives used in the examples are listed in Table 1.

TABLE I

| Additive | Label |
|---|---|
| Ferrocene | FEC |
| N,N-Disalicylidene-1,3-diaminopropane | DSP |
| Tris(perfluorophenyl)phosphate | TFP |
| Triphenylphosphine | TPP |
| zinc 2-ethyl-hexyl dithiophosphate | ZDDP |
| Dinonylnaphthalene-calcium sulfonate (modified according to U.S. Pat. No. 4,895,674 and marketed by King Industries; Norwalk, CT) | CDNS |
| Dodecenyl succinic acid methylhemiester (as marketed e.g. by King Industries) | DSHM |

The tests used to characterize the fluorosilicone formulations for antiwear properties are described as follows.

The first test method was a wear and friction test using a reciprocating test rig and performed as follows. A 6.0 mm diameter steel ball was held in a chuck and loaded downwards against the flat face of a 10.0 mm diameter steel disc. The disc was held in a bath which was two thirds filled with the test lubricant such that the contact area between the ball and flat face of the disc was fully immersed in the lubricant during the reciprocating motion. The bath was heated by using a control system such that the temperature could be set at any value between room temperature and 300° C. The stroke length, stroke frequency and other conditions of this test being indicated in Table IA, below.

Three values were continuously monitored throughout a test and logged by a microcomputer: the lubricant temperature, the coefficient of friction and the electrical contact resistance. The last was measured by applying a small voltage (15 mV) across the contact and provided an indication of the extent to which an insulating film was formed between the ball and flat. At the end of the test, the wear scar on the ball was determined using a microscope. This scar generally had an elliptical shape and the product of the measured major and minor axes was calculated as representative of the wear scar area.

TABLE IA

| | |
|---|---|
| Stroke length | 1000 μm |
| Stroke frequency | 50 Hz |
| Load | 10 N |
| Duration | 120 minutes |
| Temperature | 150° C., 200° C. |
| Ball properties | AISI 52100, 800 VPN* ($Kgf/mm^2$) |
| Disc properties | AISI 52100, 650 VPN* ($Kgf/mm^2$). |

*VPN is a standard measurement of hardness obtained by pressing a small metallic pyramid onto the material.

In the above experiment, a new ball and a new disc were used in each test. Prior to a test, the ball, disc, bath and ball holder were ultrasonically cleaned twice in acetone. The rig was then assembled and the bath filled with the test oil. The load was applied and the temperature was raised to the required value. A vibrator was switched on and the test carried out. At the end of the test, the ball was rinsed in acetone and the wear scar measured.

The second method used to test the antiwear properties of the lubricant compositions in the examples was a four ball wear test according to ASTM D 2266 (steel balls; run at speed=1200 rpm, load=40 kg and time=60 minutes). This test was run at temperatures of 100°, 150° and 200° C.

The wear and friction measurements were performed using fluorosilicone fluids of the type shown in formula (i), supra, wherein $R_f$ is $CF_3$. These fluids were obtained from the Dow Corning Corporation, Midland, Mich. and those employed were Dow Corning FS®1265 fluids having nominal viscosities of 300 cs and 1,000 cs (at 25° C.), designated as FS 300 and FS 1000, respectively.

The above described additives were dissolved in the fluorosilicone base fluids at a temperature of 80° C. Each mixture was aged at this temperature for 4 hours using an ultrasonic generator, then left to cool to room temperature overnight.

Test results are reported in Tables from 2 to 5 for the reciprocating test rig and coefficient of friction (COF) and in Tables 6–7 for the four ball tests.

From the experimental data it can be concluded that the balance of combined properties of the various tests is effective for all the FS compositions tested. The improvement is especially evident when the viscosity of the base fluid is higher. In all the cases, the best results were obtained with a ternary system of additives (i.e., those which included components (B), (C) and (D)).

TABLE 2

(Comparison Examples)
Reciprocating rig test (120 minutes, 50 Hz, Load = 10 N)

| Fluid | Additives | 150° C. Mean wear scar area ($mm^2$) | 200° C. Mean wear scar area ($mm^2$) |
|---|---|---|---|
| FS 300 | None | 0.45 | 0.54 |
| FS 300 | 0.1% ZDDP | 0.18 | — |
| FS 300 | 0.05% TPP | 0.1 | 0.45 |
| FS 300 | 0.1% TPP | 0.09 | 0.22 |
| FS 300 | 0.1% FEC | 0.53 | 0.54 |
| FS 1000 | None | 0.35 | 0.63 |
| FS 1000 | 0.1% TFP | 0.34 | — |
| FS 1000 | 0.1% ZDDP | — | 0.48 |
| FS 1000 | 0.05% TPP | — | 0.47 |
| FS 1000 | 0.1% TPP | 0.25 | 0.37 |
| FS 1000 | 0.2% TPP | — | 0.21 |
| FS 1000 | 0.1% FEC | — | 0.54 |
| FS 1000 | 0.05% CDNS | — | 0.50 |

TABLE 3

Reciprocating rig test (120 minutes, 50 Hz, Load = 10 N)

| Fluid | Additives | 150° C. Mean wear scar area ($mm^2$) | 200° C. Mean wear scar area ($mm^2$) |
|---|---|---|---|
| FS 300 | 0.1% TPP, 0.1% FEC | 0.08 | 0.21 |
| FS 300 | 0.1% ZDDP, 0.1% FEC | 0.18 | 0.32 |
| FS 300 | 0.1% TPP, 0.1% ZDDP | 0.20 | — |
| FS 1000 | 0.1% TPP, 0.1% FEC | — | 0.18 |
| FS 1000 | 0.2% TPP, 0.1% FEC | — | 0.08 |
| FS 1000 | 0.1% ZDDP, 0.1% FEC | — | 0.40 |
| FS 1000 | 0.2% ZDDP, 0.1% FEC | — | 0.23 |
| FS 1000 | 0.2% TPP, 0.2% DSP | — | 0.19 |

TABLE 4

Reciprocating rig test (120 minutes, 50 Hz, Load = 10 N)

| Fluid | Additives | 150° C. Mean wear scar area ($mm^2$) | 200° C. Mean wear scar area ($mm^2$) |
|---|---|---|---|
| FS 300 | 0.1% TPP, 0.1% ZDDP, 0.1% FEC | 0.1% | 0.18 |
| FS 300 | 0.2% TPP, 0.1% FEC, 0.05% DSHM | | 0.13 |
| FS 1000 | 0.2% TPP, 0.1% FEC, 0.05% DSHM | | 0.02 |
| FS 1000 | 0.2% TPP, 0.1% FEC, 0.05% CDNS | | 0.07 |
| FS 1000 | 0.2% TPP, 0.1% DSP, 0.05% DSHM | | 0.20 |

TABLE 5

Reciprocating rig test (120 minutes, T = 200° C., 50 Hz, Load = 10 N)

| Fluid | Additives | Mean wear scar area ($mm^2$) | Friction coefficient (COF) |
|---|---|---|---|
| FS 1000 | None | 0.63 | 0.170 |
| FS 1000 | 0.1% ZDDP | 0.48 | 0.140 |
| FS 1000 | 0.05% TPP | 0.47 | 0.150 |
| FS 1000 | 0.1% TPP | 0.37 | 0.140 |
| FS 1000 | 0.2% TPP | 0.21 | 0.080 |
| FS 1000 | 0.1% TPP, 0.1% FEC | 0.18 | 0.048 |
| FS 1000 | 0.2% TPP, 0.1% FEC | 0.08 | 0.040 |
| FS 1000 | 0.2% TPP, 0.1% FEC, 0.05% DSHM | 0.02 | 0.050 |
| FS 1000 | 0.2% TPP, 0.1% FEC, 0.1% DSHM | 0.02 | 0.040 |

TABLE 6

Four Ball test

| Fluid | Additives | 100° C. Wear scar area ($mm^2$) | 150° C. Wear scar area ($mm^2$) | 200° C. Wear scar area ($mm^2$) |
|---|---|---|---|---|
| FS 300 | None | 0.89 | 1.74 | 2.01 |
| FS 300 | 0.1% ZDDP | 0.35 | 1.00 | 1.34 |
| FS 300 | 0.05% TPP | 1.19 | 1.36 | 1.30 |
| FS 300 | 0.05% TPP, 0.1% ZDDP | 0.35 | 1.16 | 2.23 |
| FS 300 | 0.05% TPP, 0.12% FEC | 0.41 | 1.26 | 1.51 |
| FS 300 | 0.1% TPP, 0.12% FEC | 0.26 | 1.40 | 1.43 |
| FS 300 | 0.15% ZDDP, 0.05% TPP, 0.12% FEC | 0.34 | 0.73 | 1.25 |

TABLE 7

| Fluid | Additives | Four Ball test 100° C. Wear scar area ($mm^2$) | 150° C. | 200° C. |
|---|---|---|---|---|
| FS 1000 | None | 1.80 | 2.90 | 3.10 |
| FS 1000 | 0.1% ZDDP | | | 1.39 |
| FS 1000 | 0.05% TPP | 0.52 | 0.29 | 1.16 |
| FS 1000 | 0.18% FEC | 0.75 | 0.75 | 1.15 |
| FS 1000 | 0.05% TPP, 0.1% ZDDP | 0.36 | 0.49 | 1.05 |
| FS 1000 | 0.05% TPP, 0.12% FEC | 0.17 | 0.23 | 0.89 |
| FS 1000 | 0.2% TPP, 0.1% FEC | — | 0.64 | 1.03 |
| FS 1000 | 0.2% TPP, 0.1% DSP | — | 0.65 | — |
| FS 1000 | 0.2% TPP, 0.1% FEC, 0.1% DSHM | — | 0.50 | 1.47 |
| FS 1000 | 0.2% TPP, 0.1% DSP, 0.1% DSHM | — | 0.53 | 0.51 |
| FS 1000 | 0.2% TPP, 0.1% FEC, 0.1% CDNS | — | 0.62 | 1.05 |
| FS 1000 | 0.2% TPP, 0.1% DSP, 0.1% CDNS | — | 0.68 | 1.09 |
| FS 1000 | 0.1% ZDDP, 0.05% TPP, 0.12% FEC | 0.18 | 0.39 | 1.17 |

That which is claimed is:

1. A method for reducing the frictional wear of metal surfaces, said method comprising applying to the metal surfaces a blend comprising:

(A) a fluorosilicone oil;

(B) at least one compound selected from the group consisting of ferrocene, 1,1'-bis(diphenylphosphino) ferrocene and an N,N-disalicylidene-diaminoalkane in which the alkane portion has 3–6 carbon atoms; and (C) at least one phosphorous compound selected from the group consisting of triphenylphosphine, tri-o-tolylphosphine, 1,5-bis-diphenylphosphinopentane and zinc dialkyldithiophosphate in which the alkyl groups have 1–14 carbon atoms, wherein said components (B) and said component (C) is each present at a level of 0.01 to 0.3 percent based on the total weight of (A), (B) and (C).

2. The method according to claim 1, wherein said compound (B) is 1,1'bis(diphenylphosphino) ferrocene and said component (C) is selected from the group consisting of tri-o-tolylphosphine and 1,5-bis-diphenylphosphinopentane.

3. The method according to claim 1, wherein said component (B) and said component (C) are present at a level of 0.05 to 0.2% based on the total weight of (A), (B) and (C).

4. The method according to claim 2, wherein said component (B) and said component (C) are present at a level of 0.05 to 0.2% based on the total weight of (A), (B) and (C).

5. The method according to claim 1, wherein said blend further comprises (D) at least one compound selected from the group consisting of a dialkyl naphthalene sulphonate salt in which the alkyl groups have 6 to 12 carbon atoms modified with an alkenyl succinic acid or succinic acid hemiester in which the alkenyl groups have 6 to 18 carbon atoms and an alkenyl succinic acid hemiester in which the alkenyl groups have 6 to 18 carbon atoms.

6. The method according to claim 5, wherein component (D) is selected from the group consisting of dinonyl naphthalene sulphonic acid calcium salt modified with an alkenyl succinic acid or succinic acid hemiester in which the alkenyl groups have 6 to 18 carbon atoms, dodecenyl succinic acid methyl hemiester.

7. The method according to claim 6, wherein component (D) is present at a level of 0.01 to 0.2% based on the total weight of said composition.

8. The method according to claim 1, wherein said fluorosilicone oil (A) has the formula $$(CH_3)_3\ Si—\{O—Si(CH_3)(CH_2CH_2R_f)\}_p—O\ Si(CH_3)_3$$

where $R_f$ is $C_nF_{2n+1}$, in which n is an integer having a value of 1 to 4 and p has a value such that the viscosity of said oil (A) is 50 to 10,000 cs at 25° C.

9. The method according to claim 8, wherein the viscosity of said oil (A) is 800 to 1,600 cs at 25° C. and $R_f$ is $CF_3$.

10. The method according to claim 9, wherein said component (B) is selected from the group consisting of ferrocene and N,N-disalicylidene-1,3-diaminopropane and said component (C) is selected from the group consisting of tri-phenylphosphine and zinc 2-ethylhexyl dithio-phosphate.

11. The method according to claim 9, wherein said blend further comprises (D) at least one compound selected from the group consisting of a dialkyl naphthalene sulphonate salt in which the alkyl groups have 6 to 12 carbon atoms modified with an alkenyl succinic acid or succinic acid hemiester in which the alkenyl groups have 6 to 18 carbon atoms and an alkenyl succinic acid hemiester in which the alkenyl groups have 6 to 18 carbon atoms.

12. The method according to claim 11, wherein said component (B) is selected from the group consisting of ferrocene and N,N-disalicylidene-1,3-diaminopropane, said component (C) is selected from the group consisting of triphenyl-phosphine and zinc 2-ethylhexyl dithiophosphate and said component (D) is selected from the group consisting of dinonylnaphthalene-calcium-sulfonate modified with an alkenyl succinic acid or succinic acid hemiester in which the alkenyl groups have 6 to 18 carbon atoms and dodecenyl succinic acid methylhemiester.

13. A composition comprising:

(A) a fluorosilicone oil;

(B) at least one compound selected from the group consisting of ferrocene, 1,1'-bis(diphenylphosphino) ferrocene and an N,N-disalicylidene-diaminoalkane in which the alkane portion has 3–6 carbon atoms; and (C) at least one phosphorous compound selected from the group consisting of triphenylphosphine, tri-o-tolylphosphine, 1,5-bis-diphenylphosphinopentane and zinc dialkyldithiophosphate in which the alkyl groups have 1–14 carbon atoms, wherein said components (B) and said component (C) is each present at a level of 0.01 to 0.3 percent based on the total weight of (A) , (B) and (C).

14. The composition according to claim 13, wherein said compound (B) is 1,1'bis(diphenylphosphino) ferrocene and said component (C) is selected from the group consisting of tri-o-tolylphosphine and 1,5-bis-diphenylphosphinopentane.

15. The composition according to claim 13, wherein said component (B) and said component (C) are present at a level of 0.05 to 0.2% based on the total weight of (A), (B) and (C).

16. The composition according to claim 14, wherein said component (B) and said component (C) are present at a level of 0.05 to 0.2% based on the total weight of (A), (B) and (C).

17. The composition according to claim 13, wherein said blend further comprises (D) at least one compound selected from the group consisting of a dialkyl naphthalene sulphonate salt in which the alkyl groups have 6 to 12 carbon atoms modified with an alkenyl succinic acid or succinic acid hemiester in which the alkenyl groups have 6 to 18 carbon atoms and an alkenyl succinic acid hemiester in which the alkenyl groups have 6 to 18 carbon atoms.

18. The composition according to claim 17, wherein component (D) is selected from the group consisting of dinonyl naphthalene sulphonic acid calcium salt modified with an alkenyl succinic acid or succinic acid hemiester in which the alkenyl groups have 6 to 18 carbon atoms and, dodecenyl succinic acid methyl hemiester.

19. The composition according to claim 18, wherein component (D) is present at a level of 0.01 to 0.2% based on the total weight of said composition.

20. The composition according to claim 13, wherein said fluorosilicone oil (A) has the formula $$(CH_3)_3\ Si—\{(O—Si(CH_3)(CH_2CH_2R_f)\}_p—O\ Si(CH_3)_3$$

where $R_f$ is $C_nF_{2n+1}$, in which n is an integer having a value of 1 to 4 and p has a value such that the viscosity of said oil (A) is 50 to 10,000 cs at 25° C.

21. The composition according to claim 20, wherein the viscosity of said oil (A) is 800 to 1,600 cs at 25° C. and $R_f$ is $CF_3$.

22. The composition according to claim 21, wherein said component (B) is selected from the group consisting of ferrocene and N,N-disalicylidene-1,3-diaminopropane and said component (C) is selected from the group consisting of tri-phenylphosphine and zinc 2-ethylhexyl dithio-phosphate.

23. The composition according to claim 21, wherein said blend further comprises (D) at least one compound selected from the group consisting of a dialkyl naphthalene sulphonate salt in which the alkyl groups have 6 to 12 carbon atoms modified with an alkenyl succinic acid or succinic acid hemiester in which the alkenyl groups have 6 to 18 carbon atoms and an alkenyl succinic acid hemiester in which the alkenyl groups have 6 to 18 carbon atoms.

24. The composition according to claim 23, wherein said component (B) is selected from the group consisting of ferrocene and N,N-disalicylidene-1,3-diaminopropane, said component (C) is selected from the group consisting of triphenyl-phosphine and zinc 2-ethylhexyl dithiophosphate and said component (D) is selected from the group consisting of dinonylnaphthalene-calcium-sulfonate modified with an alkenyl succinic acid or succinic acid hemiester in which the alkenyl groups have 6 to 18 carbon atoms, dodecenyl succinic acid methylhemiester.

25. The method according to claim 1, wherein said component (B) is ferrocene and said component (C) is triphenylphosphine.

26. The method according to claim 5, wherein said component (B) is ferrocene, said component (C) is triphenylphosphine and said component (D) is dodecenyl succinic acid methylhemiester.

27. The composition according to claim 13, wherein said component (B) is ferrocene and said component (C) is triphenylphosphine.

28. The composition according to claim 27, wherein said component (B) and said component (C) are present at a level of 0.05 to 0.2% based on the total weight of (A), (B) and (C).

29. The composition according to claim 17, wherein said component (B) is ferrocene, said component (C) is triphenylphosphine and said component (D) is dodecenyl succinic acid methylhemiester.

30. The composition according to claim 29, wherein component (D) is present at a level of 0.01 to 0.2% based on the total weight of said composition.

* * * * *